US011454154B2

(12) United States Patent
Fey

(10) Patent No.: US 11,454,154 B2
(45) Date of Patent: Sep. 27, 2022

(54) METHOD AND PROCESSING UNIT FOR ADAPTING MODELED REACTION KINETICS OF A CATALYTIC CONVERTER

(71) Applicant: Robert Bosch GmbH, Stuttgart (DE)

(72) Inventor: Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/465,530

(22) Filed: Sep. 2, 2021

(65) Prior Publication Data

US 2022/0065152 A1 Mar. 3, 2022

(30) Foreign Application Priority Data

Sep. 3, 2020 (DE) ..... 102020211108.1

(51) Int. Cl.
*F01N 11/00* (2006.01)
*F01N 9/00* (2006.01)

(52) U.S. Cl.
CPC ..... *F01N 11/007* (2013.01); *F01N 9/00* (2013.01); *F01N 11/002* (2013.01)

(58) Field of Classification Search
CPC combination set(s) only.
See application file for complete search history.

(56) References Cited

U.S. PATENT DOCUMENTS

2010/0050607 A1* 3/2010 He ..... F01N 3/035 60/274
2012/0090297 A1* 4/2012 Yacoub ..... F01N 3/0885 60/276
2014/0032189 A1* 1/2014 Hehle ..... F01N 9/005 703/2
2014/0358355 A1* 12/2014 Zimmerschied .... F02D 41/1495 701/31.1
2015/0233315 A1* 8/2015 Kumar ..... F02D 41/0295 60/274
2016/0265414 A1* 9/2016 Devarakonda ..... F01N 3/101
(Continued)

FOREIGN PATENT DOCUMENTS

DE 10125759 A1 11/2002
DE 10339063 A1 2/2005
(Continued)

*Primary Examiner* — Binh Q Tran
(74) *Attorney, Agent, or Firm* — Michael Best & Friedrich LLP

(57) ABSTRACT

A method for adapting modeled reaction kinetics of a reaction taking place in a catalytic converter, with model-based fill level feedback control. The method includes specifying a setpoint value for at least one fill level of at least one exhaust-gas component that can be stored in the catalytic converter; calculating at least one fill level of the catalytic converter using a signal of an exhaust-gas sensor upstream of the catalytic converter and using a catalytic converter model with at least one storage capacity and reaction kinetics of the at least one reaction taking place in the catalytic converter; setting an air-fuel mixture such that the calculated fill level approximates the specified setpoint value; ascertaining a difference between a signal of the exhaust-gas sensor upstream of the catalytic converter and a signal of an exhaust-gas sensor downstream of the catalytic converter; and deactivating the fill-level-dependent setting of the air-fuel mixture.

8 Claims, 2 Drawing Sheets

(56) References Cited

U.S. PATENT DOCUMENTS

| | | | | |
|---|---|---|---|---|
| 2018/0320571 | A1* | 11/2018 | Fey | F02D 41/1441 |
| 2019/0309698 | A1* | 10/2019 | Eckart | F02D 41/1458 |

FOREIGN PATENT DOCUMENTS

| | | | |
|---|---|---|---|
| DE | 102016222418 | A1 | 5/2018 |
| DE | 102018216980 | A1 | 4/2020 |
| DE | 102018251720 | A1 | 7/2020 |

* cited by examiner

METHOD AND PROCESSING UNIT FOR ADAPTING MODELED REACTION KINETICS OF A CATALYTIC CONVERTER

BACKGROUND OF THE INVENTION

The present invention relates to a method for adapting modeled reaction kinetics of a catalytic converter, and to a processing unit and a computer program for carrying out said method.

In internal combustion engines of motor vehicles, for example diesel engines, gasoline engines or rotary piston engines, in the event of an incomplete combustion of the air-fuel mixture, a large number of combustion products aside from nitrogen ($N_2$), carbon dioxide ($CO_2$) and water ($H_2O$) are emitted, of which at least hydrocarbons (HC), carbon monoxide (CO) and nitrogen oxides (NOx) are limited by legislation. The applicable exhaust-gas limit values for motor vehicles can, in the current state of the art, be adhered to only by way of catalytic exhaust-gas after-treatment. Through the use of a three-way catalytic converter, for example, the stated pollutant components can be converted into relatively non-hazardous exhaust-gas components, for example carbon dioxide, nitrogen and water.

A simultaneously high conversion rate for HC, CO and NOx is, in the case of three-way catalytic converters, attained only in a narrow lambda range around the stoichiometric operating point (lambda=1), the so-called "catalytic converter window". Typically, for the operation of the catalytic converter in the catalytic converter window, lambda feedback control is used which is based on the signals of lambda probes upstream and downstream of the catalytic converter. For the feedback control of the lambda value upstream of the catalytic converter, the oxygen content of the exhaust gas upstream of the catalytic converter is measured by means of the lambda probe. In a manner dependent on this measured value, the feedback control corrects the fuel quantity that is fed to the internal combustion engine. For more exact feedback control, the exhaust gas downstream of the catalytic converter is additionally analyzed by means of a further lambda probe. This signal is used for master control, which is superposed on the lambda feedback control upstream of the catalytic converter. As a lambda probe downstream of the catalytic converter, use is generally made of a two-step lambda probe, which has a very steep characteristic curve at lambda=1 and can therefore indicate lambda=1 very exactly.

Aside from the master control, which generally corrects only small deviations from lambda=1 and which is configured to be relatively slow, present engine control systems generally include a functionality which, in the form of lambda pilot control, ensures that the catalytic converter window is attained again quickly after large deviations from lambda=1.

Many present feedback control concepts have the disadvantage that they identify a departure from the catalytic converter window, on the basis of the voltage of the two-step lambda probe downstream of the catalytic converter, only at a late point in time.

An alternative to the feedback control of the three-way catalytic converter based on the signal of a lambda probe downstream of the catalytic converter is feedback control of the mean oxygen fill level of the catalytic converter. Since this mean fill level cannot be measured, it can only be modeled with the aid of a system model. Such a form of feedback control can identify impending breakthroughs at an early point in time and react to these before they actually occur. Corresponding model-based feedback control of the fill level of a three-way catalytic converter based on the kinetics of the most important reactions taking place in the catalytic converter and of the oxygen storage capacity is described in DE 10 2016 222 418 A1. Stored sets of model parameters may also be incorporated into such model-based catalytic converter feedback control. An adaptation of the storage capacity of the catalytic converter which is dependent on the present operating point is also possible. Such methods are known for example from DE 10 2018 216 980 A1 and DE 10 2018 251 720 A1.

SUMMARY OF THE INVENTION

According to the invention, a method for adapting modeled reaction kinetics of at least one reaction taking place in a catalytic converter, with model-based fill level feedback control, and a processing unit and a computer program for carrying out said method, are proposed.

Model-based feedback control of the fill level of a three-way catalytic converter, as is described for example in the abovementioned DE 10 2016 222 418 A1, constitutes the field of the present invention. For better understanding, the most important functionalities thereof, specifically a system model, fill level pilot control, fill level feedback control, and an adaptation, will be described once again briefly here.

The system model is for example made up of an input emissions model, a catalytic converter model and an output lambda model.

By means of the input emissions model, the signal in the lambda probe upstream of the catalytic converter is converted into one or more input variables for the subsequent catalytic converter model. It is advantageous here for the signal of the lambda probe to be converted into the concentration of one or more exhaust-gas components. For example, a conversion of lambda into the concentrations of oxygen, carbon monoxide, hydrogen and hydrocarbons upstream of the catalytic converter is advantageous.

The catalytic converter model models at least one fill level of the catalytic converter using the variables calculated by means of the input emissions model and possibly additional input variables (for example exhaust-gas or catalytic converter temperatures, exhaust-gas mass flow and present maximum oxygen storage capacity of the catalytic converter). In order to be able to replicate filling and emptying processes more realistically, it is preferable for the catalytic converter to be divided into multiple (axial) zones, and the concentrations of the individual exhaust-gas constituents are ascertained by means of reaction kinetics for each of said zones. Said concentrations can in turn each be converted into a fill level of the individual zones, preferably into the oxygen fill level normalized with respect to the present maximum oxygen storage capacity. The present maximum oxygen storage capacity in this case describes the oxygen storage capacity that the catalytic converter would have under the present operating conditions if it were completely emptied of oxygen. The fill levels of individual or all zones may be combined, by means of suitable weighting, to form an overall fill level that reflects the state of the catalytic converter. For example, in the simplest case, the fill levels of all zones may be weighted equally, and thus a mean fill level can be ascertained. With suitable weighting, it is however also possible to take into consideration that the fill level in a relatively small region at the exit of the catalytic converter is decisive for the present exhaust-gas composition downstream of the catalytic converter, whilst the fill level in the present volume, and the development thereof, are decisive for the development of the fill level in said small region at the exit of the catalytic converter. For the sake of simplicity, a mean oxygen fill level will be assumed below.

The abovementioned reaction kinetics describe a progression with respect to time of reactions taking place in the catalytic converter, for example of an introduction of oxygen into storage in the catalytic converter and/or a release of oxygen from storage in the catalytic converter. Corresponding reaction kinetics may also be ascertained and taken into consideration for other reactions, for example an oxidation of rich-gas components, a reduction of nitrogen oxides and the like. In particular, all reaction kinetics are distinguished by a time constant that describes the time required for the reaction of a predetermined substance quantity in the presence of a predetermined concentration of the corresponding reaction partner. Typically, reaction kinetics are temperature-dependent, such that corresponding reaction kinetics to be taken into consideration may be stored for example as a characteristic curve in the form of a temperature-dependent time constant in a memory of a control unit.

The concentrations, calculated with the aid of the catalytic converter model, of the individual exhaust-gas components at the exit of the catalytic converter are, for the adaptation of the system model, converted into a signal that can be compared with the signal of an exhaust-gas sensor downstream of the catalytic converter. Preferably, the lambda value downstream of the catalytic converter is modeled. This modeling of the lambda value downstream of the catalytic converter constitutes the output lambda model.

The fill level pilot control may be configured as an inversion of the system model. This has the advantage that the feedback controller only has to intervene if the actual fill level of the catalytic converter modeled with the aid of the system model deviates from the setpoint fill level trajectory that is calculated by the pilot control. Whereas the system model converts the input lambda upstream of the catalytic converter into a (mean) oxygen fill level of the catalytic converter, the pilot control converts the mean setpoint oxygen fill level into a corresponding setpoint lambda upstream of the catalytic converter.

The (mean) oxygen fill level modeled with the aid of the system model can be adjusted by feedback control to a setpoint value that minimizes the likelihood of breakthroughs of lean or rich exhaust gas and thus leads to minimal emissions. The setpoint value is preferably prefiltered. Both the pilot control and a feedback controller are fed with the prefiltered setpoint value for the oxygen fill level as reference variable. The output signals of the pilot control and of the feedback controller are summated. The sum signal constitutes the setpoint lambda upstream of the catalytic converter.

Since the input variables of the system model, in particular the signal of the lambda probe upstream of the catalytic converter, are subject to uncertainties, the system model can be adapted. The pilot control and possibly feedback controller parameters can likewise be adapted. The signal of a lambda probe downstream of the catalytic converter, for example, serves as a basis for the adaptation. In this way, the system model is adapted in the event of breakthroughs of rich or lean exhaust gas through the catalytic converter, such that these breakthroughs become more seldom over time.

A method according to the invention for adapting modeled reaction kinetics of at least one reaction taking place in a catalytic converter with a model-based fill level feedback control comprises specification of a setpoint value for at least one fill level, in the catalytic converter, of at least one exhaust-gas component that can be stored in the catalytic converter, calculation of at least one fill level of the catalytic converter using a signal of an exhaust-gas sensor upstream of the catalytic converter and using a catalytic converter model with at least one storage capacity and reaction kinetics of the at least one reaction taking place in the catalytic converter, fill-level-dependent setting of a composition of an air-fuel mixture such that the calculated fill level approximates to the specified setpoint value, ascertainment of a difference between a detected signal of the exhaust-gas sensor upstream of the catalytic converter and a detected signal of an exhaust-gas sensor downstream of the catalytic converter, and deactivation of the fill-level-dependent setting of the composition of the air-fuel mixture, renewed ascertainment of the difference between the signals of the exhaust-gas sensors upstream and downstream of the catalytic converter in the case of deactivated fill-level-dependent setting of the composition of the air-fuel mixture, and correction of the reaction kinetics of the at least one reaction taking place in the catalytic converter in accordance with a discrepancy between the differences between the detected signals of the exhaust-gas sensors upstream and downstream of the catalytic converter in the case of activated and deactivated fill-level-dependent setting of the composition of the air-fuel mixture. In this way, the method can adapt the modeled reaction kinetics of the at least one reaction to the actually prevailing kinetics, such that the model and reality approximate to one another, which has a positive effect on the control and/or the feedback control.

For the catalytic converter model described in the introduction, the kinetics of the most important reactions taking place in the catalytic converter are required. These reactions are for example the adsorption of gaseous oxygen on the catalyst material or the oxidation of gaseous carbon monoxide with stored oxygen. It is however also possible for more or other reactions to be taken into consideration. The kinetics of each of the reactions taken into consideration are, in the context of the application, ascertained in a manner dependent on a catalytic converter temperature, for example the mean catalytic converter temperature, and stored for example in the form of a temperature-dependent characteristic curve in the engine control unit. It is preferable for the reaction kinetics to be ascertained for different stages of aging of the catalytic converter, for example for a new catalytic converter and for an aged catalytic converter, and to be stored in each case in the form of a set of model parameters in the control unit. Interpolation between the various model parameter sets can then be performed in a manner dependent on the age of the catalytic converter.

Owing to component variance and different aging behavior, deviations between the modeled and the actual reaction kinetics can occur in the field over the service life of a vehicle. These deviations have the effect that the model-based feedback control does not optimally set the fill level of the catalytic converter if the reaction kinetics are incorporated both into the system model and into the pilot control, configured as an inversion of the system model, of the catalytic converter fill level. This leads to increased emissions. The adaptation of the system model as discussed in the introduction duly permanently compensates the symptoms of these deviations but not the cause thereof. If the adaptation requirement becomes too great, there is a risk that it cannot be compensated quickly enough, or that unjustified fault entries are made in the fault memory of the control unit. For example, the control unit may assume that the lambda probe upstream of the catalytic converter is defective if the adaptation requirement becomes too great. The method according to the invention has the advantage that it is directed to the cause of the deviation and thus avoids the stated problems through the adaptation of the modeled reaction kinetics.

In the adaptation of the reaction kinetics, use is made of the fact that deviations of the modeled reaction kinetics from the actual reaction kinetics become noticeable only when the control intervention for the feedback control of the fill level of the catalytic converter is active, because only this feedback control uses the modeled reaction kinetics. In the event of a deviation of the reaction kinetics, this feedback control sets not the correct, emissions-optimized fill level of the catalytic converter but a fill level which is too low or too high. This leads to an excessively rich or an excessively lean exhaust-gas lambda downstream of the catalytic converter. The adaptation discussed in the introduction compensates this with the aid of the two-step lambda probe downstream of the catalytic converter, which leads to a stoichiometric exhaust-gas lambda=1 downstream of the catalytic converter but to a correspondingly leaner or richer exhaust-gas lambda upstream of the catalytic converter. Incorrect or erroneous modeling of the reaction kinetics in this context in the event of an active control intervention for the fill level feedback control thus leads to an increased deviation between the lambda values upstream and downstream of the catalytic converter.

In the case of an inactive control intervention, the modeled reaction kinetics do not play a role, and the stated increased deviation between the lambda values upstream and downstream of the catalytic converter does not arise. A lambda difference that possibly remains is caused exclusively by a lambda probe offset or a so-called fuel trim error that may arise owing to a leak in the exhaust-gas system. Inaccuracies in the modeled reaction kinetics however do not influence this remaining lambda difference.

The method according to the invention therefore provides for the difference between the lambda values measured upstream of the catalytic converter and downstream of the catalytic converter in the case of an activated control intervention for the feedback control of the fill level of the catalytic converter and in the case of a deactivated control intervention of said feedback control to be compared.

If the feedback control concept otherwise functionally corresponds to the model-based adapted feedback control concept discussed in the introduction, the discrepancy between the lambda differences in the case of activated and deactivated control intervention is attributable exclusively to deviations between the modeled and the actual reaction kinetics. An adaptation requirement for the modeled reaction kinetics is derived from the discrepancy between the two lambda differences. The adaptation requirement may for example be taken from a characteristic curve, which is stored in the control unit, as a function of the discrepancy between the two lambda differences. The modeled reaction kinetics are adapted such that the discrepancy between the lambda differences in the case of activated and deactivated control intervention vanishes. The modeled reaction kinetics then correspond to the actual reaction kinetics. If, for example, the discrepancy between the lambda differences in the case of activated and deactivated control intervention is positive, that is to say the lambda difference in the case of activated control intervention is greater than that in the case of deactivated control intervention, then this indicates that, in the case of activated control intervention, a (greater degree of) leaning is required in order to set a stoichiometric exhaust gas lambda downstream of the catalytic converter. That is to say, a richer exhaust-gas lambda than expected is actually set downstream of the catalytic converter. This indicates that the reaction kinetics for the introduction of oxygen into storage in the catalytic converter are actually taking place more quickly than corresponds to the kinetics stored in the control unit. Consequently, the kinetics stored in the control unit for the introduction of oxygen into storage are increased in order to align them with the actual kinetics. After this adaptation of the kinetics, the lambda difference in the case of activated control intervention should correspond to that in the case of deactivated control intervention. Should this not be the case after a first correction, the method may be performed repeatedly.

Since the comparison is typically performed at a particular (the presently prevailing) catalytic converter temperature, provision is made in particular for the reaction kinetics not only to be adapted for this one temperature but to also correspondingly be scaled for the other temperature sampling points stored in the control unit.

Since even a brief deactivation (lasting a few seconds) of the control intervention of the feedback control of the catalytic converter could lead to increased emissions, the comparison of the lambda differences is performed preferably only if, in the case of activated control intervention, an unexpectedly large difference between the lambda upstream of the catalytic converter and the lambda downstream of the catalytic converter is observed and there is the suspicion that a deviation of the modeled reaction kinetics from the actual reaction kinetics is present. In this case, the brief deactivation of the control intervention would lead not to an increase in the emissions but to a reduction. It is not necessary for the comparison to be carried out at short time intervals because it is a long-term effect that is being compensated here.

The comparison is preferably performed only when the present operating conditions can be expected to yield a reliable result of the comparison, that is to say in particular only in the presence of a stable catalytic converter temperature and steady-state operating conditions of the internal combustion engine (for example rotational speed, load and exhaust-gas mass flow), such that the measurements of the lambda differences with active and inactive control intervention can be performed under the same boundary conditions.

By means of the adaptation according to the invention of the reaction kinetics, the accuracy and the robustness of the model-based feedback control of the fill level of a catalytic converter over the service life of the vehicle in the field are increased. The emissions can thus be further reduced.

It is advantageous here if the fill-level-dependent setting of the composition of the air-fuel mixture is deactivated when the difference between the signals of the exhaust-gas sensors upstream and downstream of the catalytic converter deviates by more than a specified difference threshold value from an offset value. Here, the offset value may in particular be zero (that is to say no deviation between the lambda values upstream and downstream of the catalytic converter is expected) or may also deviate from zero, in particular if this is required in particular operating modes. In this way, the deactivation, which can generally have an adverse effect on the quality of the emitted exhaust gas, must be performed only when a requirement for this is identified, that is to say if an adaptation of the reaction kinetics leads to altogether reduced emissions of pollutants.

The at least one fill level advantageously describes a quantity, presently stored in the catalytic converter, of at least one exhaust-gas component of an internal combustion engine, in particular selected from the group comprising oxygen, nitrogen oxide, carbon monoxide and hydrocarbons. These are exhaust-gas constituents which are decisive for the control of the catalytic converter and which have an effect on the overall emissions behavior.

In particular, the catalytic converter may be part of an exhaust-gas aftertreatment system of a motor vehicle. This is an application in which particularly great potential for improvement can be expected and, furthermore, stringent legal requirements are imposed on corresponding exhaust-gas aftertreatment.

Preferably, before the deactivation of the fill-level-dependent setting of the composition of the air-fuel mixture, the method furthermore comprises comparison of the expected discharge of oxygen from the catalytic converter proceeding from the commencement of a purging operation of the catalytic converter until a setpoint value of the fill level of the catalytic converter is attained with the discharge of oxygen proceeding from the commencement of the purging until a reaction of the exhaust-gas sensor downstream of the catalytic converter occurs, and correction of the storage capacity of the catalytic converter model if a deviation between the two comparison variables exceeds a specified threshold value. In this way, influences on the exhaust-gas composition downstream of the catalytic converter that are not caused by the modeled reaction kinetics can be compensated already prior to the adaptation of the reaction kinetics, such that the remaining influence is caused exclusively by the reaction kinetics. In this way, the adaptation of the model to the real catalytic converter is made considerably simpler and more exact.

A processing unit according to the invention, for example a control unit of a motor vehicle, is configured, in particular in terms of programming technology, to carry out a method according to the invention.

The implementation of a method according to the invention in the form of a computer program or computer program product with program code for carrying out all of the method steps is also advantageous because this entails particularly low costs, in particular if an executing control unit is also utilized for further tasks and is therefore present in any case. Suitable data carriers for the provision of the computer program are in particular magnetic, optical and electrical memories, such as for example hard drives, flash memories, EEPROMs, DVDs and others. A download of a program via computer networks (Internet, intranet etc.) is also possible.

Further advantages and configurations of the invention will emerge from the description and from the appended drawing.

The invention is schematically illustrated in the drawing on the basis of an exemplary embodiment, and will be described below with reference to the drawing.

DETAILED DESCRIPTION

Figure 1:
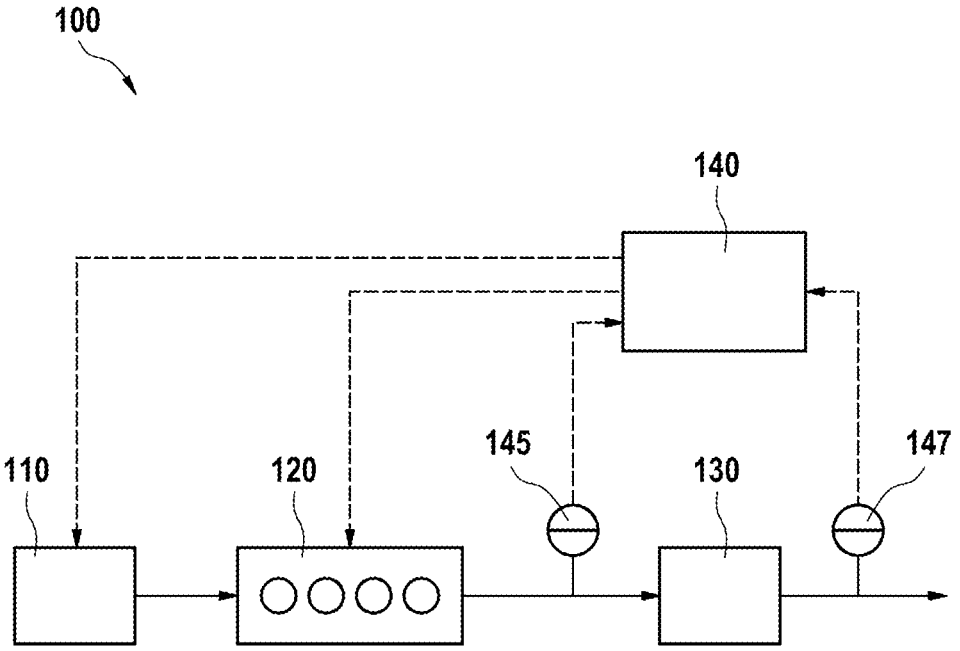
FIG. 1 shows, in a highly schematic illustration, an arrangement that is configured for carrying out an advantageous embodiment of a method according to the invention.

FIG. 1 schematically illustrates, in the form of a block diagram, an arrangement 100 which may be part of a vehicle in which a method according to the invention can be used. The arrangement 100 is preferably configured for carrying out a method 200 according to FIG. 2, and has an internal combustion engine 120, for example a gasoline engine, a catalytic converter 130 and a processing unit 140. Furthermore, the arrangement 100 may have a fuel treatment device 110, for example in the form of injection pump(s), turbocharger(s) etc., or combinations of these.

Furthermore, such an arrangement has exhaust-gas sensors 145, 147, in particular lambda probes, which are arranged upstream and downstream of the catalytic converter 130 in an exhaust-gas system of the arrangement 100.

The processing unit 140 controls, inter alia, the operation of the internal combustion engine 120, for example through control of ignition times, valve opening times and composition, quantity and/or pressure of the air-fuel mixture provided by the fuel treatment device 110.

Exhaust gas generated during the operation of the internal combustion engine 120 is fed to the catalytic converter 130. Upstream of the catalytic converter 130, the air ratio lambda of the exhaust gas is measured by means of a first lambda probe 145, and said first lambda value is transmitted to the processing unit 140. Reactions of exhaust-gas constituents with one another are accelerated, or made possible in the first place, by the catalytic converter 130, for example a three-way catalytic converter, such that hazardous constituents, such as carbon monoxide, nitrogen oxides and incompletely burned hydrocarbons, are converted into relatively non-hazardous products such as water vapor, nitrogen and carbon dioxide. Downstream of the catalytic converter 130, a second lambda value is ascertained by means of a second lambda probe 147 and is transmitted to the processing unit 140.

The first and the second lambda value may intermittently or permanently deviate from one another because, owing to the reactions in the catalytic converter 130, the compositions of the exhaust gas upstream and downstream of the catalytic converter 130 deviate from one another. Furthermore, the exhaust gas requires a certain time to flow through the catalytic converter 130 (so-called dead time). This dead time is in particular dependent on a present volume flow of the exhaust gas, that is to say on a present operating state of the internal combustion engine 120. For example, a greater exhaust-gas quantity is produced per unit of time during operation of the internal combustion engine 120 under full load than during idling operation. As a result, the respective dead time changes in a manner dependent on the operating state of the internal combustion engine 120, because the volume of the catalytic converter 130 is constant.

Figure 2:
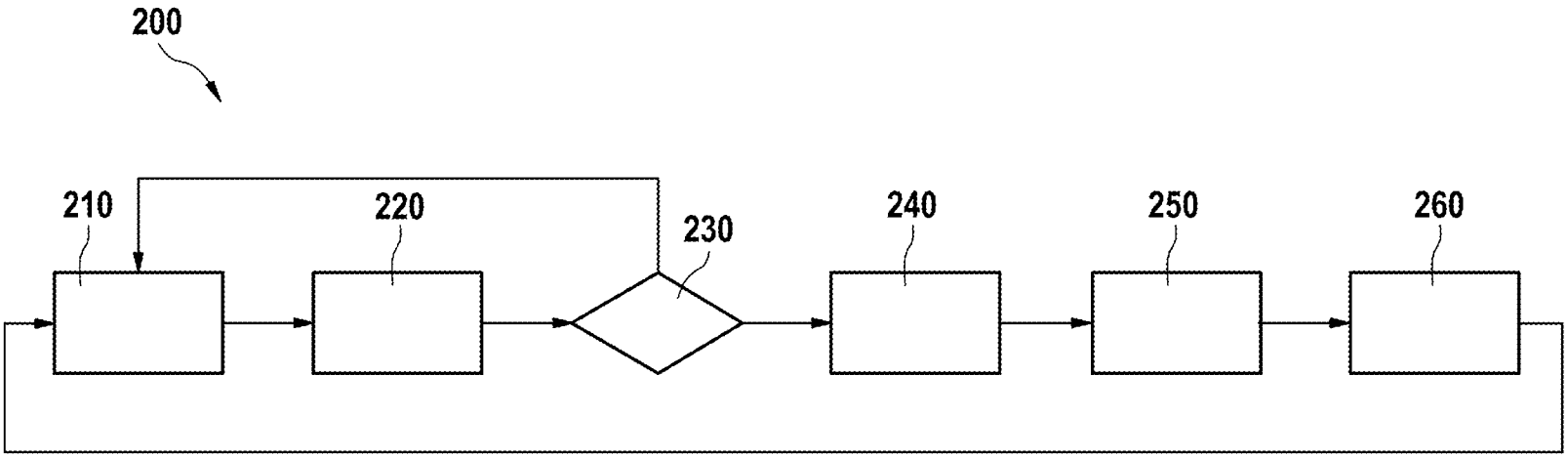
FIG. 2 shows an advantageous configuration of a method according to the invention in the form of a simplified flow diagram.

The processing unit 140 is advantageously configured to carry out the method 200 according to a preferred embodiment of the invention as illustrated in FIG. 2. For this purpose, in a normal operation step 210, the catalytic converter 130 is operated with model-based fill level feedback control, in such a way that the internal combustion engine 120 is controlled so as to generate an exhaust gas which has a composition suitable for setting a fill level of the catalytic converter 130 with respect to at least one exhaust-gas component, in particular oxygen, in accordance with a fill level specification. Here, the fill level is in particular calculated on the basis of a fill level model using measurement data from the first lambda sensor 145 described with regard to FIG. 1.

In a step 220, a first and a second lambda value are measured by means of the lambda probes 145, 147 upstream and downstream of the catalytic converter 130. This may take place both during the course of the normal operation as per step 210 and for the purposes of adaptation and/or diagnosis, for example in order to adapt the catalytic converter model for the normal operation 210, or in order to identify whether the catalytic converter 130 is functioning as intended.

In a step 230, the two ascertained lambda values of the sensors 145, 147 are compared with one another, and the difference between the two values is compared with an expected or acceptable offset value. If the difference between the first and second lambda values lies in the range of the acceptable offset value, the method 200 returns to the normal operation step 210 and adapts the catalytic converter model on the basis of the measured values if necessary.

However, if the discrepancy between the difference of the lambda values and offset value exceeds a specifiable difference threshold value, then the method 200 continues with a step 240, in which the fill level feedback control is deactivated. In a subsequent step 250, it is then once again the case that the lambda values upstream and downstream of the catalytic converter 130 are then determined, and the difference between the first and second lambda values is ascertained. The discrepancy between the differences in the case of active and deactivated fill level feedback control is used in a step 260 for the calculation of an adaptation of the reaction kinetics of at least one reaction taking place in the catalytic converter 130, for example of the introduction of oxygen into storage or the release of oxygen from storage. Since these measurements can in each case be performed only at a presently prevailing temperature, it is expediently provided that the reaction kinetics are correspondingly also adapted for other temperatures—taking into consideration a corresponding scaling parameter. For this purpose, based on the calculated adaptation of the reaction kinetics for the present temperature, it is for example possible for all stored sampling points of a corresponding temperature-dependent characteristic curve to be adapted. For example, it may be taken into consideration here that a corresponding time constant varies to a greater degree with increasing temperature, such that a temperature-dependent adaptation may comprise a combined compression or stretching and shifting of the corresponding characteristic curve.

If, accordingly, it is for example the case that the introduction of oxygen into storage in the catalytic converter 130 takes place more quickly than corresponds to the kinetics stored in the control unit 140, then lean exhaust gas is in fact better reduced, and in fact a richer exhaust-gas lambda than expected will take effect downstream of the catalytic converter 130, because the model-based feedback control 210 of the catalytic converter 130 is based on the stored kinetics. This deviation of the exhaust-gas lambda actually measured downstream of the catalytic converter 130 from the expected (typically stoichiometric) exhaust-gas lambda is a measure for the deviation of the actual kinetics from the stored kinetics. A conversion of the lambda difference into a correction factor for the kinetics may be performed for example by means of a correction characteristic curve. In the example, owing to the rich deviation of the exhaust-gas lambda in the stored kinetics, the time constant for the introduction of oxygen into storage would be reduced. Analogously, an actually more quickly occurring release of oxygen from storage would lead to a better oxidation of rich exhaust gas and to a leaner exhaust-gas lambda. Likewise, it is self-evidently possible for the adaptation of the kinetics to comprise an increase of the corresponding time constants if a correspondingly slower reaction rate is indicated by the difference between the lambda values upstream and downstream of the catalytic converter.

Since other effects that have nothing to do with the reaction kinetics can also lead to a deviation of the actual exhaust-gas lambda downstream of the catalytic converter from the expected exhaust-gas lambda downstream of the catalytic converter (for example a tolerance of the lambda sensor upstream of the catalytic converter), an adaptation of the reaction kinetics would be counter-productive in such a case. In order to separate the different causes, the difference between the lambda values is detected once in step 220 in the case of active control intervention, and once in step 250 in the case of inactive control intervention, of the model-based feedback control 210 of the catalytic converter 130. Only the discrepancy between the two differences can be caused by reaction kinetics in the catalytic converter model that do not reflect reality.

After adaptation of the stored reaction kinetics has been performed in the step 260, the method returns to the normal operation step 210 and reactivates the fill level feedback control of the catalytic converter 130.

It is self-evident that some of the steps discussed with regard to FIG. 2 may also be combined or may possibly take place in a different, for example reversed, sequence. For example, for certain diagnostic functions, it may be necessary to deactivate the fill level feedback control of the catalytic converter. If such a function is implemented, it is self-evidently also possible for the difference between the lambda values in the case of inactive fill level feedback control to firstly be ascertained before the difference in the case of active control intervention for fill level feedback control is ascertained. Furthermore, the detection of measured values and the decision as to whether a threshold value is overshot by a measured value, or by a variable derived therefrom, may for example be combined into a single step.

The invention claimed is:

1. A method (200) for adapting modeled reaction kinetics (260) of at least one reaction taking place in a catalytic converter (130), with model-based fill level feedback control (210), the method comprising:

specification of a setpoint value for at least one fill level, in the catalytic converter, of at least one exhaust-gas component that can be stored in the catalytic converter;

calculation, via a processing unit (140), of at least one fill level of the catalytic converter using a signal of an exhaust-gas sensor (145) upstream of the catalytic converter (130) and using a catalytic converter model with at least one storage capacity and reaction kinetics of the at least one reaction taking place in the catalytic converter (130);

fill-level-dependent setting of a composition of an air-fuel mixture such that the calculated fill level approximates to the specified setpoint value;

ascertainment (220) of a difference between a detected signal of the exhaust-gas sensor (145) upstream of the catalytic converter (130) and a detected signal of an exhaust-gas sensor (147) downstream of the catalytic converter (130); and deactivation (240) of the fill-level-dependent setting of the composition of the air-fuel mixture, renewed ascertainment (250) of the difference between the signals of the exhaust-gas sensors (145, 147) upstream and downstream of the catalytic converter (130) in the case of deactivated fill-level-dependent setting of the composition of the air-fuel mixture, and correction (260) of the reaction kinetics of the at least one reaction taking place in the catalytic converter (130) in accordance with a discrepancy between the differences between the detected signals of the exhaust-gas sensors upstream and downstream of the catalytic converter in the case of activated and deactivated fill-level-dependent setting of the composition of the air-fuel mixture.

2. The method (200) according to claim 1, wherein the fill-level-dependent setting of the composition of the air-fuel mixture is deactivated (240) when the difference between the signals of the exhaust-gas sensors (145, 147) upstream and downstream of the catalytic converter (130) deviates (230) by more than a specified difference threshold value from an offset value.

3. The method (200) according to claim 1, wherein the at least one fill level describes a quantity, presently stored in the catalytic converter (130), of at least one exhaust-gas component of an internal combustion engine (120) selected from the group consisting of oxygen, nitrogen oxide, carbon monoxide and hydrocarbons.

4. The method (200) according to claim 1, wherein the catalytic converter (130) is part of an exhaust-gas aftertreatment system of a motor vehicle.

5. The method (200) according to claim 1, furthermore comprising, before the deactivation (240) of the fill-level-dependent setting of the composition of the air-fuel mixture:

comparison of an expected discharge of oxygen from the catalytic converter proceeding from the commencement of a purging operation of the catalytic converter until a setpoint value of the fill level of the catalytic converter is attained with a discharge of oxygen proceeding from the commencement of the purging until a reaction of the exhaust-gas sensor (147) downstream of the catalytic converter (130) occurs, and correction of the storage capacity of the catalytic converter model if a deviation between the two comparison variables exceeds a specified threshold value.

6. The method (200) according to claim 1, wherein the correction (260) of the reaction kinetics comprises a correction of time constants of the at least one reaction for at least two different temperatures of the catalytic converter (130).

7. The method (200) according to claim 1, wherein the correction (260) of the reaction kinetics is performed such that there is subsequently no discrepancy between the differences in the signals of the exhaust-gas sensors (145, 147) upstream and downstream of the catalytic converter (130) in the case of activated and deactivated fill-level-dependent setting of the composition of the air-fuel mixture.

8. A non-transitory, computer-readable medium containing instructions that when executed by a computer cause the computer to adapt modeled reaction kinetics (260) of at least one reaction taking place in a catalytic converter (130), with model-based fill level feedback control (210), by:

specifying a setpoint value for at least one fill level, in the catalytic converter, of at least one exhaust-gas component that can be stored in the catalytic converter;

calculating at least one fill level of the catalytic converter using a signal of an exhaust-gas sensor (145) upstream of the catalytic converter (130) and using a catalytic converter model with at least one storage capacity and reaction kinetics of the at least one reaction taking place in the catalytic converter (130);

fill-level-dependent setting of a composition of an air-fuel mixture such that the calculated fill level approximates to the specified setpoint value;

ascertaining (220) a difference between a detected signal of the exhaust-gas sensor (145) upstream of the catalytic converter (130) and a detected signal of an exhaust-gas sensor (147) downstream of the catalytic converter (130); and deactivating (240) the fill-level-dependent setting of the composition of the air-fuel mixture, renewed ascertainment (250) of the difference between the signals of the exhaust-gas sensors (145, 147) upstream and downstream of the catalytic converter (130) in the case of deactivated fill-level-dependent setting of the composition of the air-fuel mixture, and correction (260) of the reaction kinetics of the at least one reaction taking place in the catalytic converter (130) in accordance with a discrepancy between the differences between the detected signals of the exhaust-gas sensors upstream and downstream of the catalytic converter in the case of activated and deactivated fill-level-dependent setting of the composition of the air-fuel mixture.

* * * * *